US005178170A

United States Patent [19]

Kassai

[11] Patent Number: 5,178,170

[45] Date of Patent: Jan. 12, 1993

[54] EYELASH SHIELD DEVICE AND METHOD

[76] Inventor: Lee Kassai, 2335 S. Bentley Ave., Los Angeles, Calif. 90064

[21] Appl. No.: 736,526

[22] Filed: Jul. 26, 1991

[51] Int. Cl.[5] ..... A45D 40/30

[52] U.S. Cl. ..... 132/319; 132/216

[58] Field of Search ..... 132/212, 216, 218, 317, 132/318, 319, 320

[56] References Cited

U.S. PATENT DOCUMENTS

| | | | |
|---|---|---|---|
| D. 119,329 | 3/1940 | Leyne | 132/216 |
| D. 123,237 | 10/1940 | Schmucker | 132/318 |
| 1,873,928 | 8/1932 | Bohner | 132/216 |
| 1,907,476 | 5/1933 | Ballard et al. | 132/216 |
| 1,974,825 | 9/1934 | Lovie | 132/216 |
| 2,094,006 | 9/1937 | O'Moore-Farrell | 132/318 |
| 2,260,614 | 10/1941 | Freitas | 132/216 |
| 2,294,257 | 8/1942 | Udvarhely et al. | 132/318 |
| 2,804,082 | 8/1957 | Dewing | 132/318 |
| 2,984,247 | 5/1961 | Laughton | 132/318 |
| 3,789,856 | 2/1974 | Bomba | 132/319 |
| 3,884,232 | 5/1975 | Braun | 132/333 |
| 4,033,364 | 7/1977 | Inzana et al. | 132/216 |
| 5,016,658 | 5/1991 | Green | 132/319 |

FOREIGN PATENT DOCUMENTS

| | | | |
|---|---|---|---|
| 930552 | 1/1948 | France | 132/318 |
| 0111148 | 7/1944 | Sweden | 132/319 |

*Primary Examiner*—Cary E. O'Connor
*Assistant Examiner*—Frank A. LaViola
*Attorney, Agent, or Firm*—Hubbard, Thurman, Tucker & Harris

[57] ABSTRACT

An eyelash shield device is provided having curvatures at each end of an elongated member. The invention also includes a process for using a makeup device to apply makeup to eyelash. The curved ends are applied above and below the eye, between the face and eyelashes of the user so as to protect the face from smudging eyelash makeup on the face or from disturbing pre-applied makeup to the user's face while applying mascara to the eyelashes. An alternative embodiment of the eyelash shield device has a clip for attaching the shield to a mascara case and includes first and second members pivotally connected to each other. The first functions as a shield between the user's face and eyelashes and has a curved edge conforming to the curvature of the periphery of the user's eye. The second member is pivotally attached to the first member and connected to a clip device for attachment to a mascara case.

2 Claims, 2 Drawing Sheets

EYELASH SHIELD DEVICE AND METHOD

BACKGROUND OF THE INVENTION

This invention relates to an eyelash shield device, and in particular to a device for shielding the eyelashes from the face during application of makeup to the eyelashes. The invention also relates to a process for applying eyelash makeup.

It is common to apply makeup such as mascara to eyelashes to darken and thicken the lashes. In doing so, typically a mascara brush is used to apply makeup to the eyelashes, either by the person or by a beauty assistant. In doing so, great care must be exercised to avoid smudging the face, disturbing other makeup or inadvertently applying some of the mascara into the eye causing extreme discomfort. The person using the mascara brush must exert sufficient pressure to apply the mascara to the lashes but not so much as to press the lashes against the skin where smudging will occur. This makes it difficult to apply mascara evenly on all the lashes, particularly the smaller ones.

In addition, it is often advisable to comb or brush the eyelashes either before or during application of the mascara in order to remove loose lashes and to assure an even application of mascara. This is difficult if not impossible with the prior art mascara brushes mentioned above because of the difficulty of doing so without a proper surface backing.

Consequently, there exist a need to have a device which can be used to assist the application of mascara and other makeup to the eyelashes so as to provide for an even complete application without smudging the skin or disturbing makeup around the eyes.

BRIEF SUMMARY OF THE INVENTION

Accordingly, a principle object of the present invention is to provide an eyelash shield device for placing between the eyelashes and the skin of the face when applying mascara and other makeup to the eyelashes. Another object of the present invention is to provide a device on which to support eyelashes so as to apply mascara evenly to eyelashes. Still another object of the present invention is to provide a surface for combing and brushing the eyelashes to eliminate loose lashes and to prepare the lashes for even application of makeup. Yet another object of the present invention is to enable complete and even application of mascara to eyelashes. Still another object of the present invention is to provide a simple device appropriately shaped to conform to the eye curvature so as to enable simple and easy makeup application to all four sets of eyelashes of a user.

These and other objects are accomplished in the present invention which comprises a eyelash shield device for use in applying makeup to the eyelashes of a user. The device comprises an elongated flat member having a first angled part at one end of the member with a concave curvature on the outward facing edge of the first angled part. A second angled part at the other end of the elongated flat member has a second concave curvature along the outer edge of the second angled part.

Another preferred embodiment of the present invention comprises a process for applying makeup to the eyelashes of a user without inadvertently smudging the makeup on the face of the user. A shield is placed behind each set of eyelashes so that the shield edge is adjacent to the eye and conforms to the shape thereof. Makeup is applied to the set of eyelashes while they rest against the shield. The process further comprises brushing or combing each set of eyelashes against the shield.

Another embodiment of the present invention comprises an eyelash shield device for applying makeup to the eyelashes of a user. The device includes a first elongated flat member having a concave curved edge and a second elongated member being pivotally connected to the first member. A clip is attached to the second member for clipping the shield device to a makeup case.

The novel features and construction of the invention as well as additional objects thereof will be understood more fully by the following description when read in connection with the accompanying drawings.

DESCRIPTION OF THE PREFERRED EMBODIMENT

Figure 1:
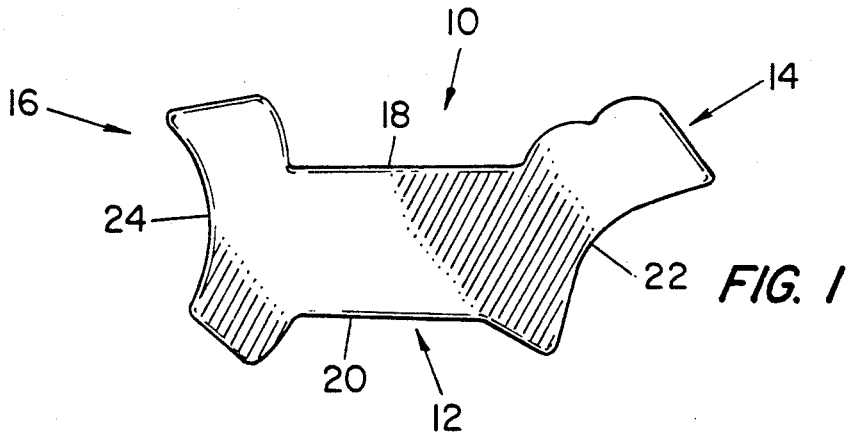
FIG. 1 is a plan view of the eyelash shield device of the present invention.

Referring now specifically to the drawings, two preferred embodiments of the present invention are shown. FIG. 1 shows a one piece integral eyelash makeup shield 10 having a central elongated portion 12, a first curved end portion 14 and a second curved end portion 16. Shield 10 is preferably flat on both sides having an identical appearance on the reverse as on the front side shown. The elongated center portion comprises two parallel sides 18 and 20 extending to meet curved end portions 14 and 16. End portion 14 comprises a concave curved edge 22 extending outward from shield 10. Second end portion 16 has an outer edge 24 having a concave curvature extending outward from shield 10.

In the present preferred embodiment, curved edge 22 has a larger radius of curvature than the radius of curvature of curved edge 24. Curved edge 22 is designed to conform to the peripheral curvature of the upper eyes of the user. Curved edge 24 is somewhat smaller in radius of curvature and is designed to conform to the peripheral curvature of the lower eyes of the user. Typically the available curvature space below the eyes is less than the curvature space above the eyes because of the user's nose.

Preferably, the radius of curvature of edge 22 is slanted at an acute angle with the longitudinal axis of shield 10, and the radius of curvature of edge 24 is substantially parallel to the longitudinal axis of shield 10. The curvatures are so angled to facilitate the process of makeup application. It is understood that these curvatures may be disposed differently without altering the invention.

Preferably, makeup device 10 is made of plastic or paper and is thin enough to be somewhat flexible for use about the eyes but is thick enough to provide a stable surface against which the eyelashes may be brushed or combed.

Figure 2:
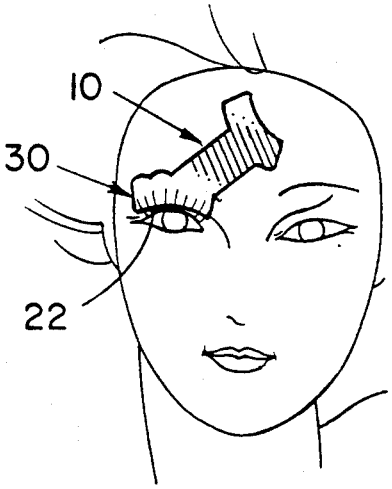
FIG. 2 is a perspective view of the shield device of FIG. 1 showing its use in applying makeup to the upper right set of eyelashes of the user.

Referring now to FIG. 2, the shield device 10 is shown in position above the right eye of a user. The shield is preferably placed against the eyebrow or skin of the user, above the upper right eyelid with the eyelashes 30 resting against the outer surface of the shield. In this position, the eyelashes may be brushed or combed to remove loose lashes and to place them evenly on the shield for application of makeup. The shield then is held in place while makeup, such as mascara, is applied evenly to the lashes.

Figure 3:
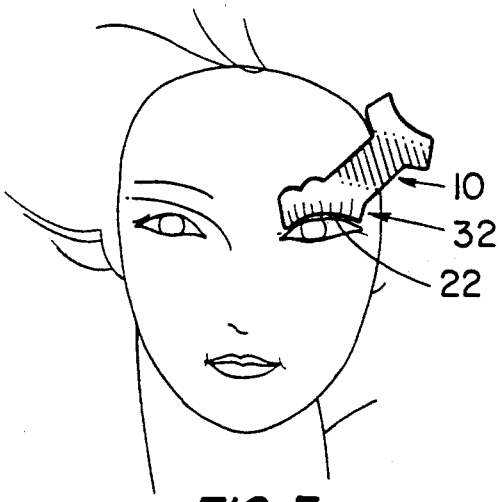
FIG. 3 is a perspective view of the shield device of FIG. 1 showing its use in applying makeup to the upper left set of eyelashes of the user.

FIG. 3 shows use of the shield device for the upper left set of eyelashes 32 of the user. The use is similar to that just described with regard to FIG. 2. Note that, preferably, the larger curvature 22 is used for both upper sets of eyelashes to accommodate the larger available curvature of the upper periphery of the eyes of the user.

Figure 4:
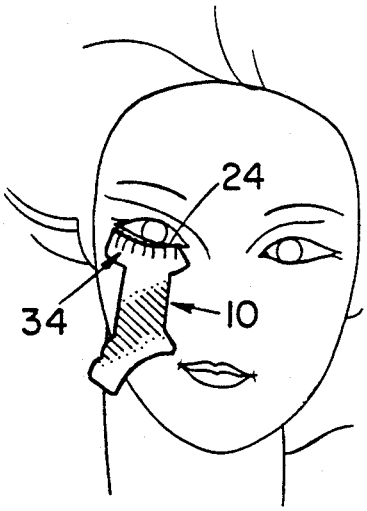
FIG. 4 is a perspective view of the shield device of FIG. 1 showing its use in applying makeup to the lower right set of eyelashes of the user.

FIG. 4 shows similar use of the makeup device for application of mascara and other makeup to the lower left eyelashes 34 of the user. It can be seen that preferably the smaller curvature 24 of the makeup device is used next to the periphery of the eye for this application. The smaller curvature end is preferably used because the available periphery of the lower eye is usually less than is available for the upper eye.

Figure 5:
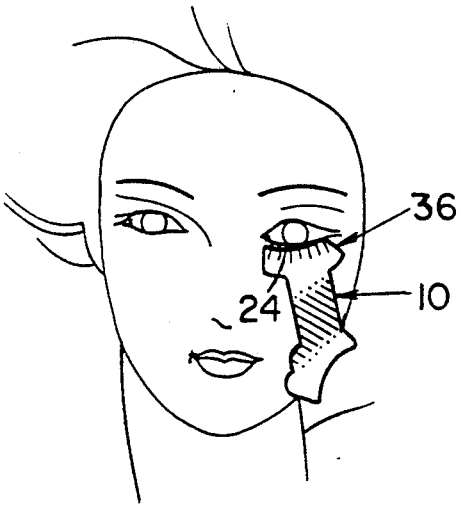
FIG. 5 is a perspective view of the shield device of FIG. 1 showing its use in applying makeup to the lower left set of eyelashes of the user.

FIG. 5 shows a similar use of the smaller curved end for application of the makeup to the lower left eyelashes 36 of the user. Note that preferably the same side of the shield is used for application of makeup to all four sets of eyelashes. Thus, the makeup on the shield is not smudged onto the face of the user.

Figure 6:
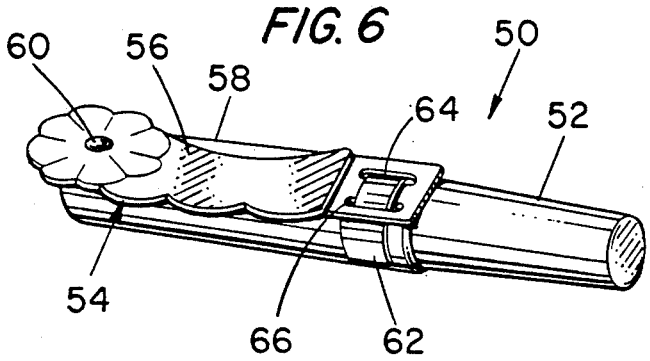
FIG. 6 is a perspective view of another eyelash shield device, in accordance with an alternative preferred embodiment of present invention, affixed to a cylindrical makeup case.
Figure 7:
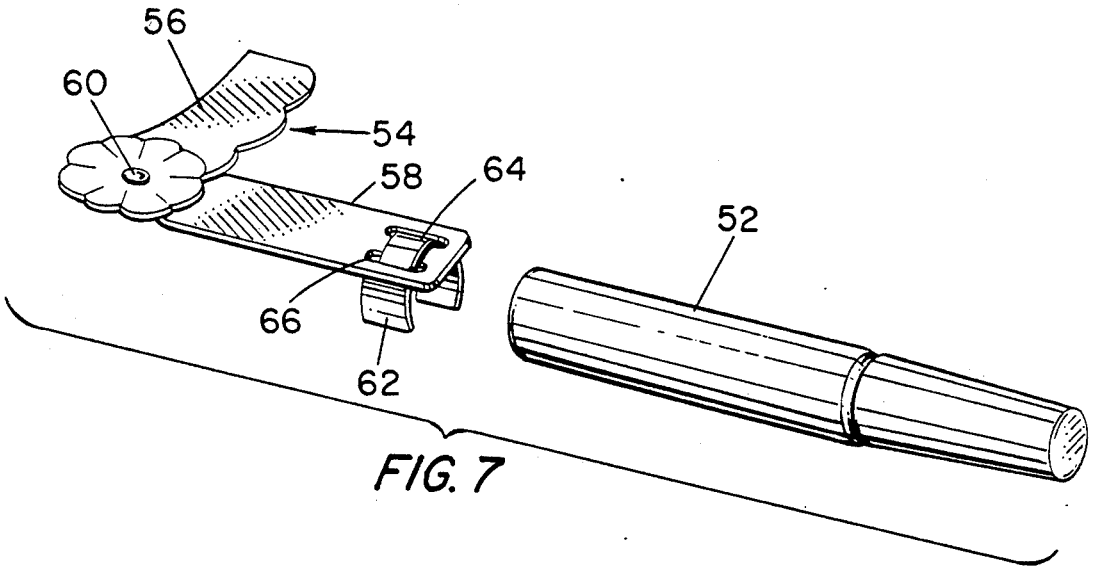
FIG. 7 is an exploded perspective view of the eyelash shield device and case shown in FIG. 6.

Referring now to FIG. 6, another eyelash shield device 50 is shown as an alternative embodiment for the present invention. The device 50 is shown attached to the cylindrical makeup case 52. FIG. 7 shows an exploded view with the device 50 removed from case 52.

Device 50 includes a first elongated member 54 having a curvature 56 running along the a longitudinal side of member 54. A second elongated member 58 is shown pivotally attached to member 56 by a brad attachment 60. A cylindrical spring-clip 62 is attached to member 58 at the opposite end from the pivotal attachment to member 54. Clip 62 is shaped to snugly conform substantially to the periphery of makeup case 52 in order to hold device 50 thereon. Preferably, spring 62 is attached to member 58 by being looped through a parallel pair of elongated slots 64 and 66, as shown.

Figure 8:
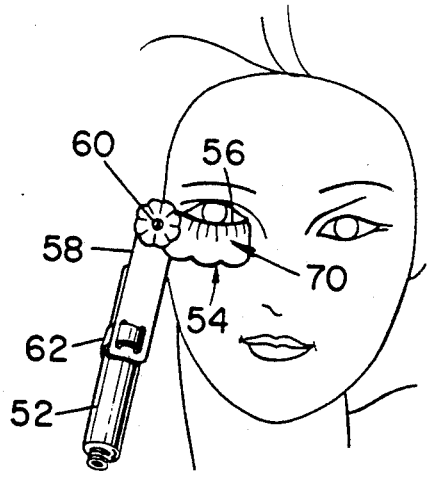
FIG. 8 is a perspective view showing use of the eyelash shield device of FIG. 6 to apply makeup on the lower right set of eyelashes of the user.

FIG. 8 shows use of the makeup device 50 of the alternate preferred embodiment of the present invention while applying mascara to the lower right set of eyelashes 70 of the user. The mascara case is inverted but the mascara is typically not liquid enough to run out of the case. The clip 62 is preferably slid up or down the periphery of cylinder 52 in order to extend sufficiently away from case 52 so as to not bring case 52 in contact with the face of the user. As shown, the curved edge 56 is positioned below the lower periphery of the user's right eye. Preferably one surface of the elongated member 54 rest on the face of the user and the other surface rest against the eyelashes 70 of the user. Elongated member 54 is pivoted about pivot point 60 relative to member 58 to adjust for ease in the application of the makeup.

Figure 9:
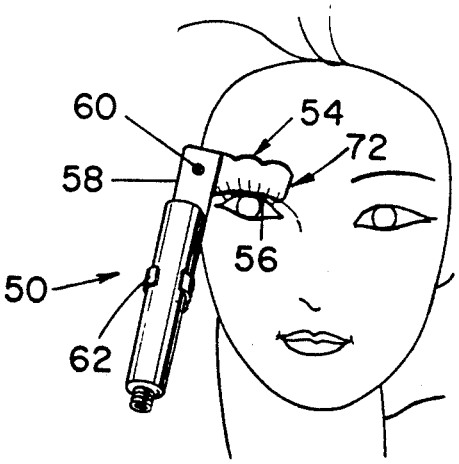
FIG. 9 is a perspective view of the eyelash device of FIG. 6 being used to apply makeup to the upper right set of eyelashes of a user.

Finally, referring to FIG. 9, the eyelash shield device 50 is shown in application of makeup to the upper right eyelashes 72 of the user. Note that the member 54 has been rotated relative to member 58 about pivot point 60 to be positioned above the upper periphery of the right eye between the face and the eyelashes of the user. Mascara is again applied to the upper eyelashes in the same manner as described here before. Shield device 50 is used in a similar manner for the right eye.

Preferably, makeup shield device 50 is also made of plastic or stiff paper with sufficient flexibility to conform to the face of the user but with sufficient rigidity to provide stability during use. Spring 62 is preferably metal to provide sufficient resiliency for holding the clip to the mascara case. Alternatively, spring 62 and member 58 may be constructed as a unitary one-piece molded plastic member.

From the foregoing, it is apparent that the present invention provides numerous advantages over the prior art. The eyelash shield of the present invention protects the skin around the eye area from being smudged while applying mascara to the eyelashes. It protects pre-applied makeup around the eye from being disturbed while applying mascara to the eyelashes. Moreover, it provides a flat surface to comb or brush eyelashes thoroughly while applying mascara to eyelashes, thereby making eyelashes thicker. The present invention further facilitates the application of mascara to the smallest of eyelashes. The eyelashes are lifted up and away from the skin during application.

While the preferred embodiments of the present invention have been illustrated and described, those skilled in the art can easily make changes without departing from the spirit and scope of the invention.

What is claimed is:

1. Eyelash shield device for use in applying makeup to the eyelashes of the eyes of a user, comprising an elongated flat member having a first curved part at one end of the member having a first concave curvature along the outer edge of said first curved part, and a second curved part at the other end of the elongated flat member having a second concave curvature along the outer edge of the second curved part, the first curvature along the edge of the first curved part having a radius which is larger than the radius of the second curvature along the edge of the second curved part, the radius of the first curvature being substantially slanted at an acute angle to the longitudinal axis of the elongated flat member, and the radius of the second curvature being substantially parallel to the longitudinal axis of the elongated member, said radius of the first curvature being curved to fit about the upper periphery of each eye behind the upper eyelashes of the user and the radius of the first curvature being slanted relative to the flat member; whereby the flat member is positioned above the periphery of the eye thereby being slanted relative to the longitudinal axis of the face of the user during use of the first curvature on the upper eyelashes, and the flat member is positioned below the periphery of the eye thereby being substantially parallel to the longitudinal axis of the face of the user during use of the second curvature on the lower eyelashes, to facilitate the application of makeup to the eyelashes.

2. A process for applying makeup to the upper and lower sets of eyelashes of a user without inadvertently smudging the makeup on the face of the user, comprising placing a shield having first and second curved edges at opposite ends of the shield behind each set of eyelashes so that the first or the second shield edge is adjacent to the eye and conforms to the shape thereof, and applying makeup to the eyelashes while the eyelashes rest against the shield, one side of said shield being used for applying makeup to all sets of eyelashes of the user, the first curved edge of the shield having a first radius of curvature larger than the second curved edge so as to be used on the upper sets of eyelashes of the user and the second curved edge of the shield having a second radius of curvature smaller than the first radius of curvature so as to be used on the lower sets of eyelashes of the user, the first radius of curvature being slanted relative to the longitudinal axis of the shield so that the shield is positioned above the periphery of the eye thereby being slanted relative to the longitudinal axis of the face of the user during use of the first curvature on the upper eyelashes, and the second radius of curvature being substantially parallel to the longitudinal axis of the shield so that the shield is positioned below the periphery of the eye thereby being substantially parallel to the longitudinal axis of the face of the user during use of the second curvature on the lower eyelashes, to facilitate the application of makeup to the eyelashes.

* * * * *